US006558271B1

(12) United States Patent
Beach et al.

(10) Patent No.: US 6,558,271 B1
(45) Date of Patent: May 6, 2003

(54) GOLF CLUB HEAD SKELETAL SUPPORT STRUCTURE

(75) Inventors: Todd P. Beach, San Diego, CA (US); Richard L. Rugge, Encinitas, CA (US); David Anderson, San Diego, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

(21) Appl. No.: 09/483,967

(22) Filed: Jan. 18, 2000

(51) Int. Cl.[7] ..... A63B 53/04

(52) U.S. Cl. ..... 473/327; 473/329; 473/346; 473/334; 473/349

(58) Field of Search ..... 473/131, 256, 473/228, 324, 345, 346, 349, 334, 335, 336, 337, 338, 339, 332, 329, 350, 291, 327

(56) References Cited

U.S. PATENT DOCUMENTS

| | | | | |
|---|---|---|---|---|
| 1,091,231 | A | * | 3/1914 | Millar |
| 1,592,463 | A | | 7/1926 | Marker |
| 1,825,244 | A | | 9/1931 | Nero |
| 1,975,307 | A | | 10/1934 | Ackerman |
| 2,460,435 | A | * | 2/1949 | Schaffer |
| 2,592,013 | A | | 4/1952 | Curley |
| 3,212,783 | A | * | 10/1965 | Bradley |
| 3,589,731 | A | | 6/1971 | Chancellor, Jr. |
| 3,606,327 | A | * | 9/1971 | Gorman |
| 4,076,254 | A | * | 2/1978 | Nygren |
| 4,213,613 | A | | 7/1980 | Nygren |
| 4,461,481 | A | | 7/1984 | Kim |
| 4,681,321 | A | | 7/1987 | Chen et al. |
| 4,732,389 | A | * | 3/1988 | Kobayashi |
| 4,811,950 | A | * | 3/1989 | Kobayashi |
| 4,930,781 | A | | 6/1990 | Allen |
| 4,988,104 | A | | 1/1991 | Shiotani et al. |
| 5,000,454 | A | | 3/1991 | Soda |
| 5,016,883 | A | | 5/1991 | Kobayashi |
| 5,060,951 | A | | 10/1991 | Allen |
| 5,295,689 | A | | 3/1994 | Lundberg |
| 5,310,186 | A | * | 5/1994 | Karsten |
| 5,346,218 | A | | 9/1994 | Wyte |
| 5,380,010 | A | | 1/1995 | Werner et al. |
| 5,385,348 | A | * | 1/1995 | Wargo |
| 5,421,577 | A | * | 6/1995 | Kobayashi |
| 5,547,427 | A | | 8/1996 | Rigal et al. |
| 5,570,886 | A | * | 11/1996 | Rigal |
| 5,613,916 | A | | 3/1997 | Sommer |
| 5,624,331 | A | | 4/1997 | Lo et al. |
| 5,681,227 | A | | 10/1997 | Sayrizi |
| 5,769,735 | A | | 6/1998 | Hosokawa |
| 5,776,009 | A | | 7/1998 | McAtee |
| 5,839,975 | A | | 11/1998 | Lundberg |
| 5,888,148 | A | | 3/1999 | Allen |
| 5,908,356 | A | | 6/1999 | Nagamoto |
| 5,911,637 | A | | 6/1999 | Yamagata |
| 5,941,782 | A | | 8/1999 | Cook |
| 5,997,415 | A | | 12/1999 | Wood |
| 6,017,280 | A | * | 1/2000 | Hubert |
| 6,059,669 | A | | 5/2000 | Pearce |

FOREIGN PATENT DOCUMENTS

| | | |
|---|---|---|
| JP | H04-347179 | 12/1992 |

OTHER PUBLICATIONS

Product Brochure, TekSource, LC 801–523–0550 (Not Dated).

* cited by examiner

*Primary Examiner*—Sebastiano Passaniti
(74) *Attorney, Agent, or Firm*—Knobbe, Martens, Olson & Bear, LLP

(57) ABSTRACT

A golf club including a shaft and a club head coupled to the shaft. The club head includes a strike face, a shell defining an interior volume and a skeletal structure. The skeletal structure advantageously comprises a plurality of elongate skeletal members and a weight substantially entirely supported by the skeletal structure, wherein the weight and the skeletal structure collectively comprise at least 30% of the entire weight of the club head.

23 Claims, 20 Drawing Sheets

GOLF CLUB HEAD SKELETAL SUPPORT STRUCTURE

BACKGROUND OF THE INVENTION

1. Field of the Invention

The present invention relates to golf clubs, and, in particular, to a golf club head having a skeletal structure which provides load support to the club head.

2. Description of the Related Art

A conventional wood-type golf club head is comprised of a load-bearing outer shell with an integral or attached strike plate. The United States Golf Association (USGA) provides golf club manufacturers with a set of rules that govern various characteristics of a wood-type club head. For example, the rules prohibit holes through the head.

Within the confines of these rules, golf club manufacturers have throughout the years experimented with the distribution of mass in the shell of the club head in order to position mass in a manner that will achieve desired performance objectives. For example, certain regions of the strike plate and/or outer shell have been thinned or thickened, thereby freeing extra mass to be positioned where needed most, such as in load bearing regions of the shell. Club heads have also been provided with strengthening structures, such as internal ribs, that bolster the strike plate or shell structure and/or distribute loads from one region of the shell to another region of the shell. Other club heads have been provided with weight plugs that are attached to the shell in order to concentrate weight in a particular region.

SUMMARY OF THE INVENTION

The Applicant has ascertained that the conventional structural framework of a load bearing outer shell attached to a strike plate does not necessarily provide a golf club with maximum performance characteristics. The ability of a golf club manufacturer to modify the performance characteristics of a golf club head can be greatly increased if the club head is not limited by this conventional structural framework. For example, a golf club manufacturer can have greater leeway in varying the performance characteristics of a golf club if the mass is located in regions not directly adjacent to the club head's outer envelope, defined by exposed portions of the strike plate and outer shell.

However, as mentioned, the allowable structure of the club head is limited by various practical considerations, such as the USGA rules. Even aside from the USGA rules, golfers have grown accustomed to the traditional club head structure so that any departure from such a structure may adversely affect the golfer's performance. The traditional outer envelope also provides benefits to the aerodynamics of the club head during the swing. Therefore, from a practical standpoint, the golf club designer must allocate at least a percentage of the mass of the club head so that the structure of the club head conforms to the traditional structure of a smooth outer envelope. However, it is greatly desirable to minimize this "structural mass" of the club head, thereby freeing up a maximum percentage of mass that the designer could judiciously allocate to performance considerations of the club head.

Thus, the present invention provides a golf club that conforms to USGA rules with respect to the structure of the club head, yet provides the golf club manufacturer with the ability to judiciously distribute mass to adjust the performance characteristics of the club head.

One aspect of the invention is a golf club comprising a shaft and a club head coupled to the shaft. The club head includes a strike face, a shell defining an interior volume, and a skeletal structure. The skeletal structure includes a plurality of elongate skeletal members. A weight is substantially entirely supported by the skeletal structure. The weight and the skeletal structure collectively comprise at least 30% of the entire weight of the club head.

Preferably, the shell of the golf club head encloses the skeletal structure. Advantageously, the golf club head includes a strike plate that defines a strike face, and at least one of the skeletal members extends rearwardly from the strike face.

Desirably, the weight is suspended within the interior volume. Preferably, the skeletal members are spaced from the shell and are attached to the periphery of the strike face.

Another aspect of the present invention is a golf club including a shaft and a club head coupled to the shaft, wherein the club head includes a strike face, a skeletal structure comprising a plurality of interlinked elongate skeletal members, and a weight supported by the skeletal structure. Preferably, the golf club head includes an outer shell defining an internal volume. Advantageously, the skeletal structure is located within the interior volume defined by the outer shell. Preferably, the skeletal structure and the weight comprise at least 30% of the weight of the club head.

Another aspect of the present invention is a golf club including a shaft and a club head coupled to the shaft. The club head comprises a strike face, a shell defining a interior volume, and a skeletal structure within the interior volume. The skeletal structure includes a plurality of elongate skeletal members, at least one of which is suspended through the interior volume. Desirably, the club further includes a weight supported by the skeletal members. Preferably, the weight and the skeletal members comprise at least 30% of the weight of the club head.

Another aspect of the present invention is a golf club, including a shaft and a golf club head coupled to the shaft. The club head includes a strike plate defining a strike face, a shell defining an interior volume, and a skeletal structure within the interior volume, wherein the strike plate and the skeletal structure bear at least 50% of the load when a golf ball is struck by the strike face.

Another aspect of the present invention is a golf club, including a shaft and a club head coupled to the shaft. The club head includes a strike face, a shell defining a strike plate and an outer shell. The club further includes a weight spaced at least 5 mm from an outer envelope defined by the outer shell and the strike plate.

Yet another aspect of the present invention is a golf club, comprising a shaft and a golf club head coupled to the shaft. The golf club head comprises a strike plate, a sole flange, and a shell defining an interior volume. The strike plate and sole flange are integrally connected, and the sole flange includes one or more weight plugs therein.

Yet another aspect of the present invention is a golf club head comprising a hollow shell, a strike plate, and one or more skeletal supports. The shell defines a cavity and has an opening at about the position of a face portion of the golf club head. The strike plate is secured to the shell so as to close the opening. The supports are secured at a first end to outer edges of the strike plate and extend within the cavity to an inner surface of a wall of the shell, the inner surface being on a side of the cavity generally opposite to the strike plate. The supports are secured at a second end to the inner surface of the shell.

Yet another aspect of the present invention is a golf club comprising a club head and a weight movably secured to the club head. In a narrower aspect, the present invention provides a golf club comprising a shaft, a club head coupled to the shaft, and a weight. The club head comprises a strike face, a shell defining an interior volume, and a skeletal structure comprised of a plurality of elongate skeletal members. The weight is substantially entirely supported by the skeletal structure, and is movable with respect to the strike face in a direction generally perpendicular to the strike face. The weight is biased by one or more resilient members, such as springs or elastomeric spring blocks. The resilience of the resilient members is such that when said club head strikes a golf ball, the compression and recovery of the club head is synchronized with the compression and recovery of the ball. In an alternative embodiment, such synchronization can be created by utilizing a compliant skeletal structure. Such compliance can be created by using curved skeletal members.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

These and other features of the invention will now be described with reference to the drawings of a preferred embodiment, which are intended to illustrate and not to limit the invention, and in which.

DETAILED DESCRIPTION OF THE PREFERRED EMBODIMENTS

Figure 1:
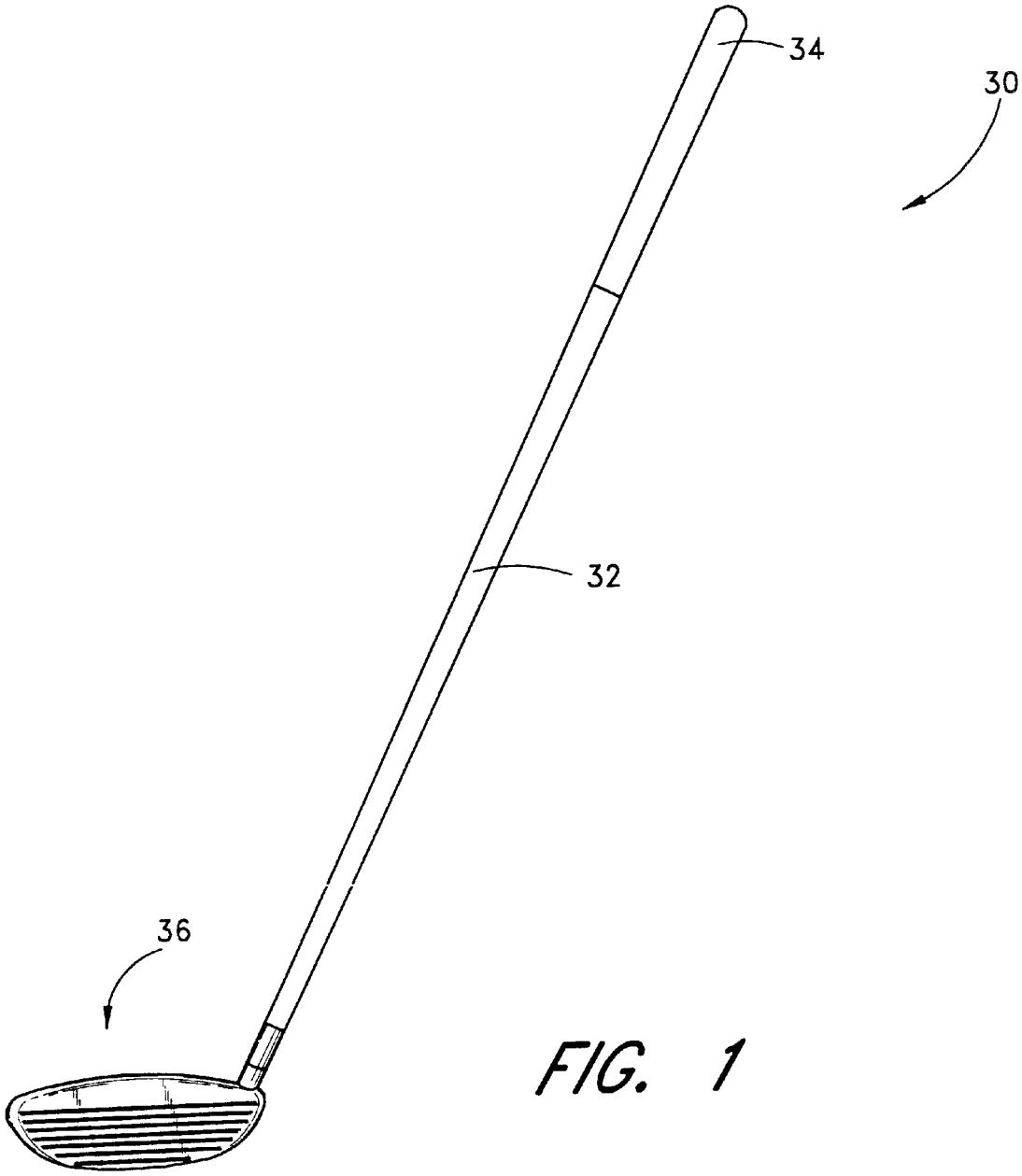
FIG. 1 is a front view of a golf club.

FIG. 1 is a perspective view of a golf club 30 comprising a shaft 32 having a grip 34 on one end. A golf club head 36 is disposed on the end of the shaft 32 opposite the grip 34. The club head 36 comprises a metal wood-type head, preferably a driver-type metal wood.

Figure 2:
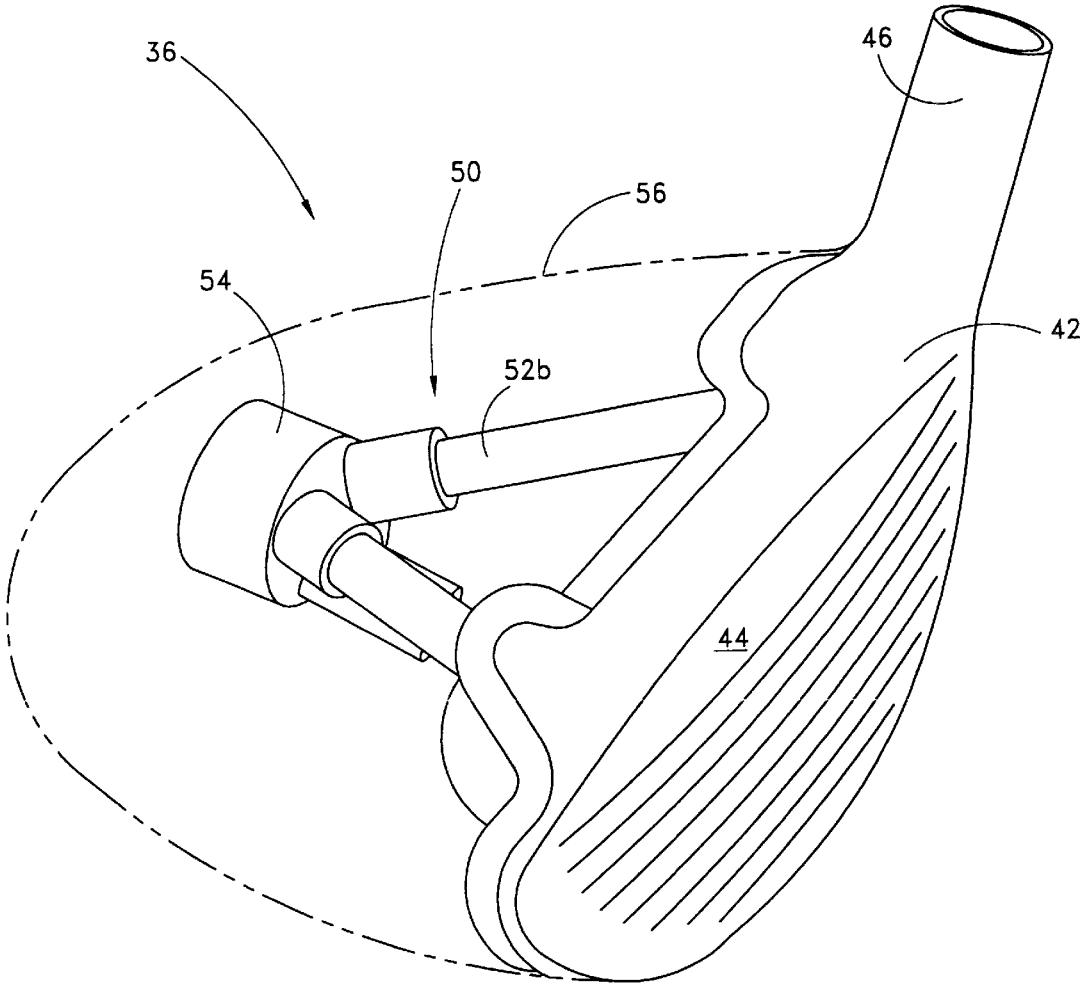
FIG. 2 is a front perspective view a golf club head having an internal skeletal structure.

With reference to FIG. 2, the club head 36 is comprised of a strike plate 42. The strike plate defines a substantially planar front surface or strike face 44 for impacting a golf ball. A hosel 46 extends upwardly from the strike plate 42. The hosel 46 is configured to be coupled to the shaft 32 in a well known manner. The club head further comprises a skeletal structure 50 comprised of a framework of one or more interlinked skeletal members, which are referred to collectively using reference numeral 52 and individually using a letter suffix. The skeletal members 52 support a large mass or weight 54 preferably comprised of a concentrated mass.

In a preferred embodiment, the club head 36 further comprises an outer shell 56 having a shape that generally conforms to the shape of a conventional driver-type metal wood golf club head. The shell 56 is securely connected along a front surface thereof to a rear surface of the strike plate 42. The shell and the strike plate 42 collectively define an outer envelope and enclose an internal volume of the club head 36. To comply with USGA rules, the shell and strike plate do not define a hole or holes through the club head 36. The internal volume is preferably at least 190 cubic centimeters and, preferably, no more than 350 cubic centimeters. For illustrative purposes, the outer shell 56 is shown to be generally transparent, although the shell 56 is not necessarily transparent.

Figure 3:
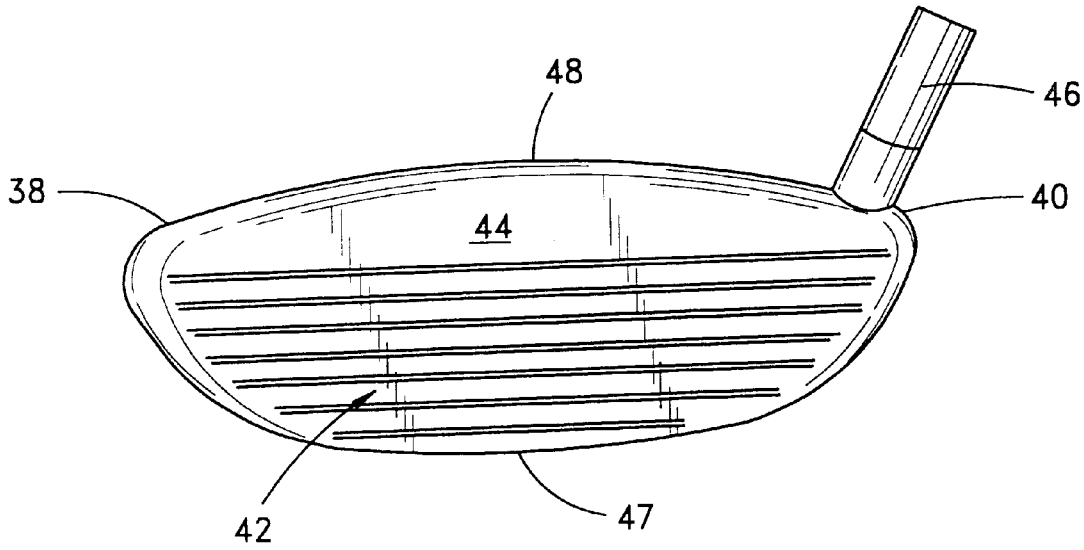
FIG. 3 is a front view of the golf club head of FIG. 2.

With reference to the front view of FIG. 3, the club head 36 includes a toe region 38 and a heel region 40, as will be known to those of skill in the art. The bottom of the club head 36 is delimited by a sole 47 and the top of the club head is delimited by a crown 48.

Figure 4:
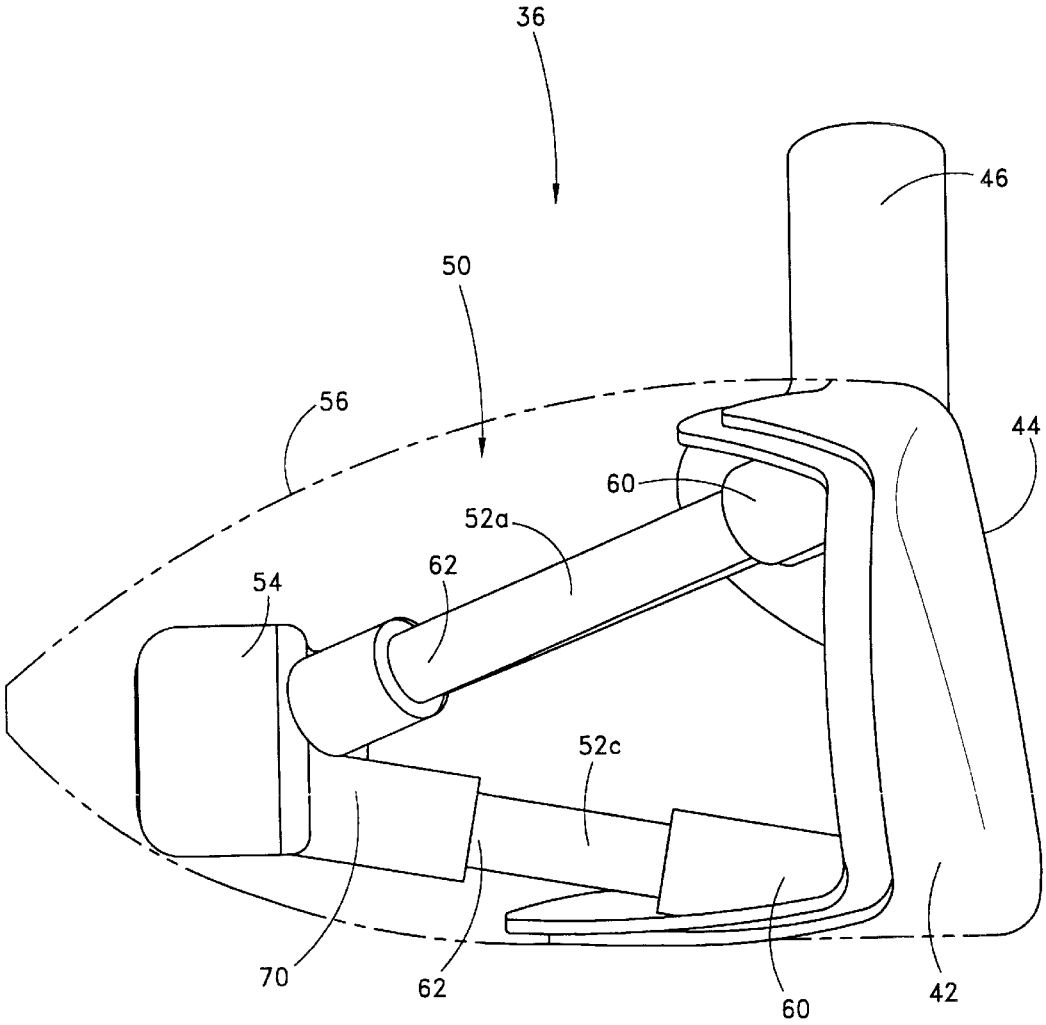
FIG. 4 is a side view of the golf club head of FIG. 2.
Figure 5:
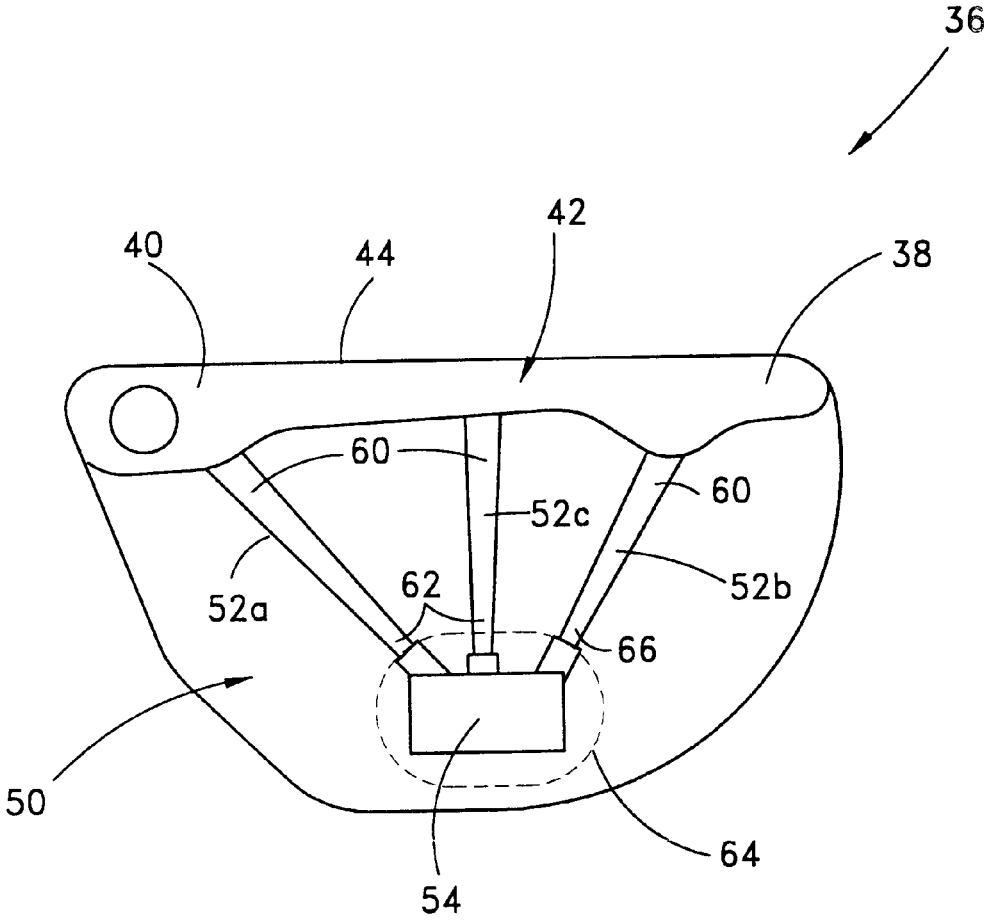
FIG. 5 is a top view of the golf club head of FIG. 2.

FIGS. 4 and 5 show side and top views, respectively, of the club head 36. In the illustrated embodiment, the skeletal structure 50 includes three interconnected struts or skeletal members 52 that are each comprised of an elongated structure having a first end 60 and a second end 62. The skeletal members 52 each have a hollow rod- or bar-like configuration with a closed polygonal or annular cross-sectional shape. This tends to maximize the strength of the skeletal members 50, while minimizing their weight, yet permits the members to be manufactured relatively inexpensively. The skeletal members 52 are connected at their first ends 60 to the strike plate 42. A pair of upper skeletal members 52*a, b* are connected near the upper edge of the strike plate 42 at the toe region 38 and heel region 40 of the club head 36. A third skeletal member 52*c* is connected near the lower edge of the strike plate 42 substantially midway between the toe region 38 and heel region 40.

The skeletal members 52 project rearwardly from the strike plate 42 such that the second ends 62 thereof converge at a convergence location 64 within the internal volume. As best shown in the side view of FIG. 4, the two upper skeletal members 52*a, b* slope downwardly toward the sole 47 of the club head 36 and the lower skeletal member 52*c* slopes upwardly toward the crown 48 of the club head 36. With reference to the top view of FIG. 5, the upper skeletal members 52*a, b* also extend inwardly from the sides toward a position spaced rearwardly from the strike face between the heel and toe of the club. In particular, the skeletal members 52*a, b* preferably extend to a position generally on a line perpendicular to the strike plate and aligned with the center point thereof. The skeletal members 52 are thereby substantially arranged in a tripod configuration.

The skeletal structure 50 functions as a rigid support structure for the club head 36. Toward this end, the skeletal members 52 and strike plate 42 are preferably arranged in an interlinked fashion, preferably with the first end 60 or second end 62 of each skeletal member 52 connected to either the first end 60 or second end 62 of another skeletal member 52 or to the strike plate 42. Additionally, advantageously at least one, desirably at least two, more desirably at least three, and preferably all of the skeletal members 52 are "suspended" within the internal volume defined by the outer shell 56. That is, at least one of the skeletal members 52 is preferably substantially free along its length except at any connection point with another skeletal member(s) 52 and/or with the strike plate 42.

As shown in FIGS. 4 and 5 the weight 54 is suspended within the interior volume at the second ends 62 of the skeletal members 52. The weight 54 desirably comprises a concentrated mass of material that is effectively entirely supported by the skeletal structure 50. Toward this end, the weight 54 is connected to a support manifold 70 (FIG. 4) that mates with the second ends 62 of the skeletal members 52. The weight 54 may be coupled to the skeletal members 52 using adhesive, screws, brazing, etc., or the weight may be integrally formed with the skeletal members 52.

Figure 6:
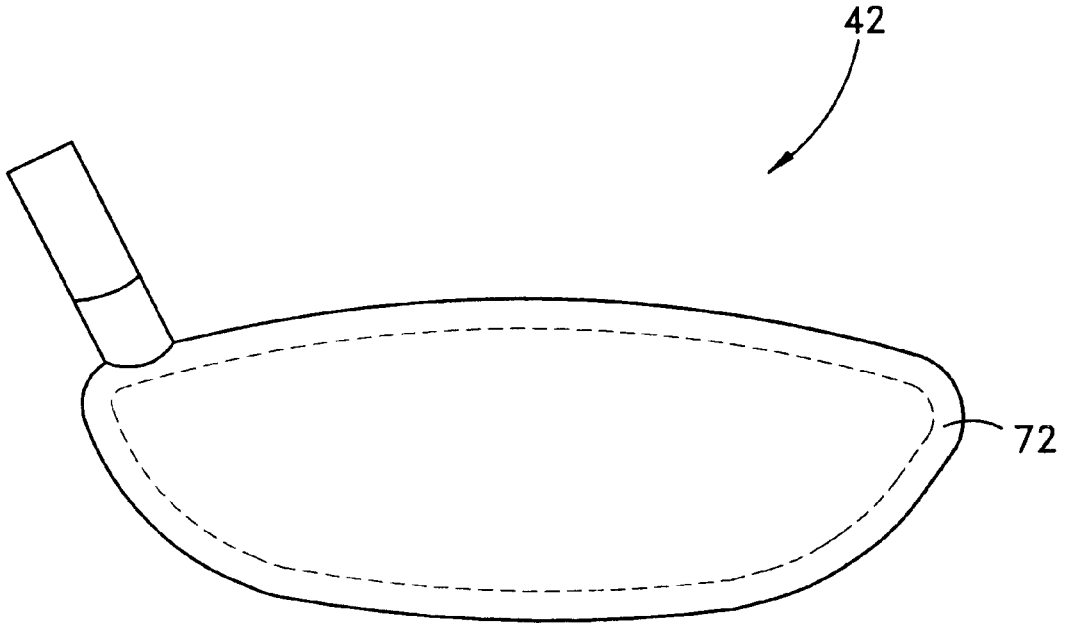
FIG. 6 is a rear view of a strike plate portion of the golf club head of FIG. 2.

FIG. 6 is a rear view of the strike plate 42. The skeletal members 52 are desirably attached within or substantially near a perimeter region 72 of the strike plate 42. Although a skeletal member 52 may be attached at or near the center of the strike plate 42, such an attachment location may interfere with the spring effect of the strike plate 42 upon impact with a golf ball. Additionally, although as little as one skeletal member 52 may be used, the skeletal structure 50 desirably comprises at least three skeletal members 52. Three skeletal members 52 may advantageously be arranged to support off-center loads on the strike plate 42 and to reduce moments about the weight 54.

The skeletal structure 50 and the weight 54 preferably collectively comprise approximately 30–80% of the entire weight of the club head 36, and more preferably comprise approximately 60–80% of the entire weight of the club head 36. The weight 54 preferably individually comprises approximately 10–40% of the entire weight of the club head 36. In one embodiment, the club head 36 has a mass of approximately 190–210 grams, wherein the shell 56 has a mass of approximately 30 grams, the skeletal structure 50 has a mass of approximately 110 grams, and the weight has a mass of approximately 60 grams.

The skeletal structure 50 is desirably characterized by a strong, lightweight, efficient structure. The skeletal structure is also desirably manufactured of a material that is configured to withstand the loads that result from impact of the club head 36 with a golf ball. Some examples of suitable materials for the skeletal members 52 are titanium, steel, aluminum, magnesium, and various composites. The strike plate 42 is also desirably manufactured of a material that will withstand impact with a golf ball, such as, for example, titanium, steel, or aluminum.

The skeletal structure 50 and the strike plate 42 desirably comprise the essential or minimum structure of the club head 36. That is, the skeletal structure 50 and the face plate 42 are collectively configured to support substantially all loads on the club head 36 at impact with a golf ball and to propel the golf ball from the strike face 44 after impact. Specifically, the strike plate and skeletal structure bear at least 50% of the load when a golf ball is struck by the strike face. Accordingly, the shell 56 does not necessarily support loads on the strike face 44 or necessarily contribute to the performance of the club head. It will be appreciated, however, that the shell 56 may be configured to transfer or support a minimal percentage of loads at impact, although the shell 56 is mainly provided to present the club head 36 with the standard shape to which most golfers are accustomed. The use of the shell 56 is also advantageous for compliance with USGA rules, which prohibit exposed gaps though a club head.

Because the shell 56 is not the primary load support member of the club head 36, the shell 56 may be manufactured of a material that is lighter and/or thinner than the material used to manufacture the skeletal structure 50 and/or the strike plate 42. The shell 56 therefore is desirably configured to use less weight than the shell of a conventional club head, so that the golf club designer has more mass available for judicious placement throughout the club head 36. The shell may also comprise a material that is not as strong or hard as the material used to manufacture the skeletal structure and/or the strike plate. The structural configuration of the club head also permits the shell 56 to be manufactured of material that is less expensive than materials used in club heads in which the club head shell must provide substantial load support. For example, the shell may comprise a material that plastically deforms when it is subject to impact with the golf ball at a speed of about 100 mph. Thus, the outer shell and strike plate advantageously comprise different materials. Some examples of suitable materials for the shell 56 are plastics, composites, magnesium, aluminum, and titanium.

In addition, it will be appreciated that certain advantages accrue due to the shorter length and smaller surface area of the skeletal structure, when contrasted with designs which depend on the outer shell for structural support. In particular, the straight skeletal members 52 which support the mass are much more efficient than a continuous shell structure, because the skeletal members are dedicated to supporting the mass. In contrast, a shell configuration has no direct load path to the mass. As a result of the skeletal structure, it is possible to make a club head having less weight and a rounder shape.

Figure 7:
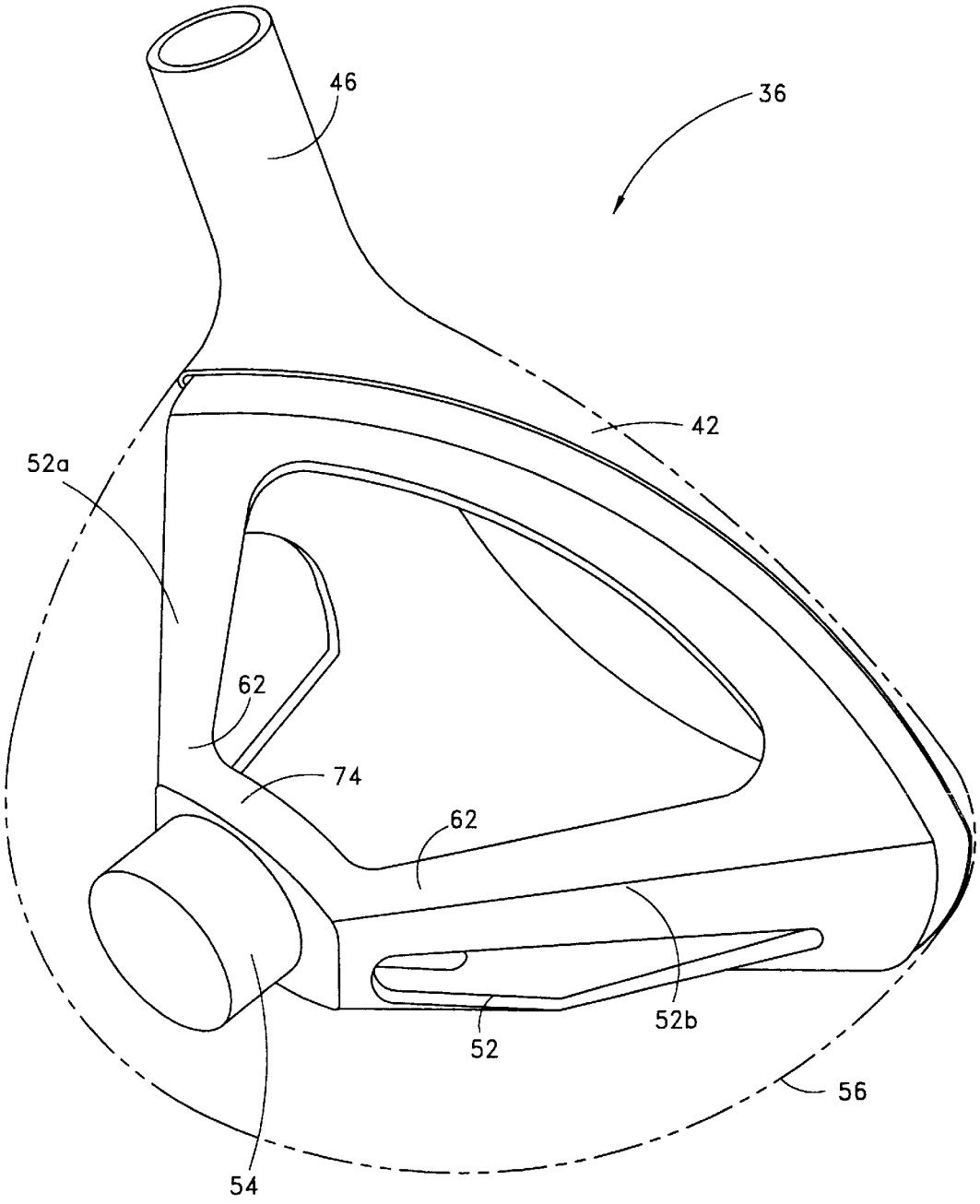
FIG. 7 is a rear perspective view of another embodiment of a golf club head having an internal skeletal structure.
Figure 8:
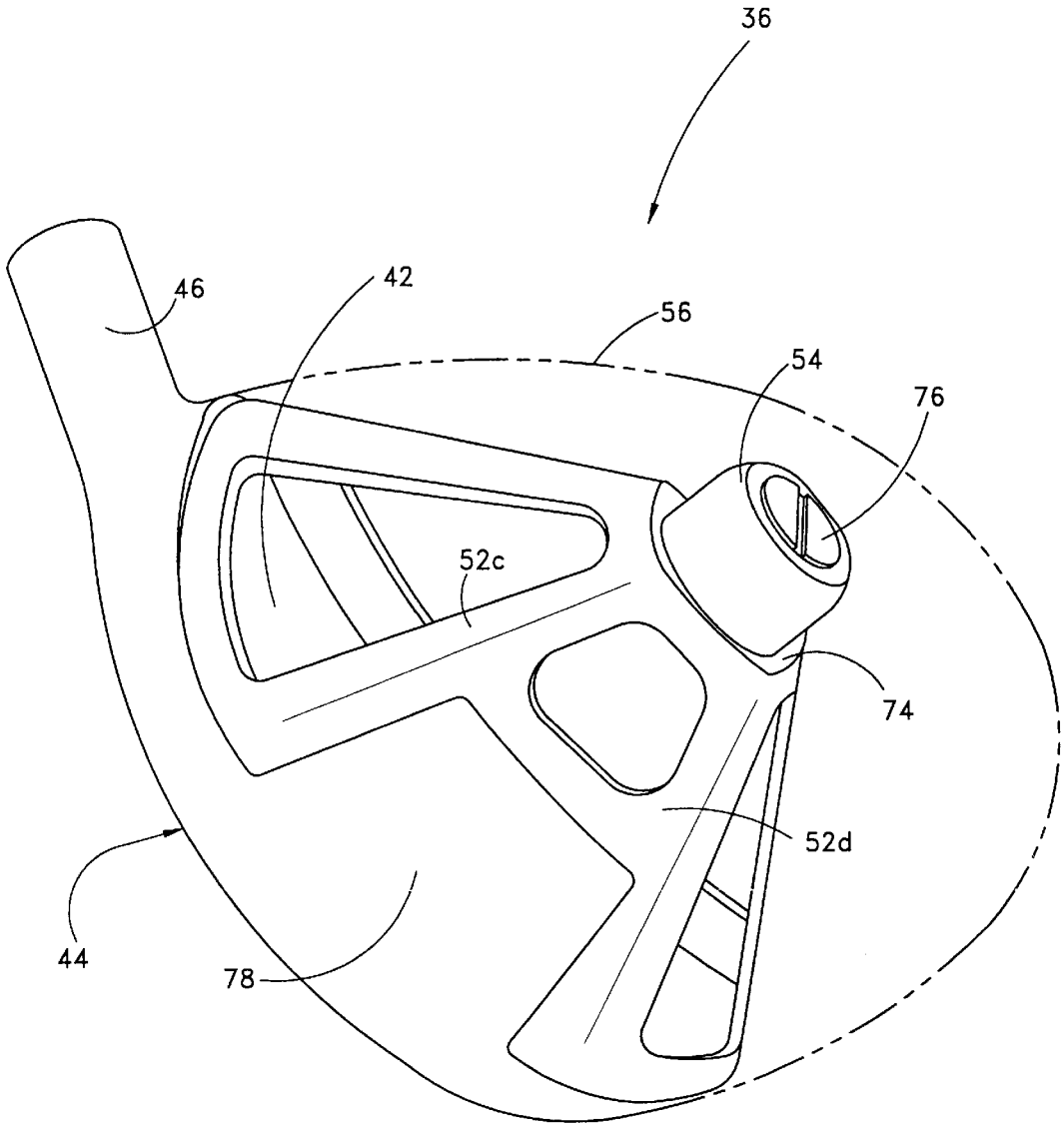
FIG. 8 is a bottom perspective view of the golf club head of FIG. 7.
Figure 9:
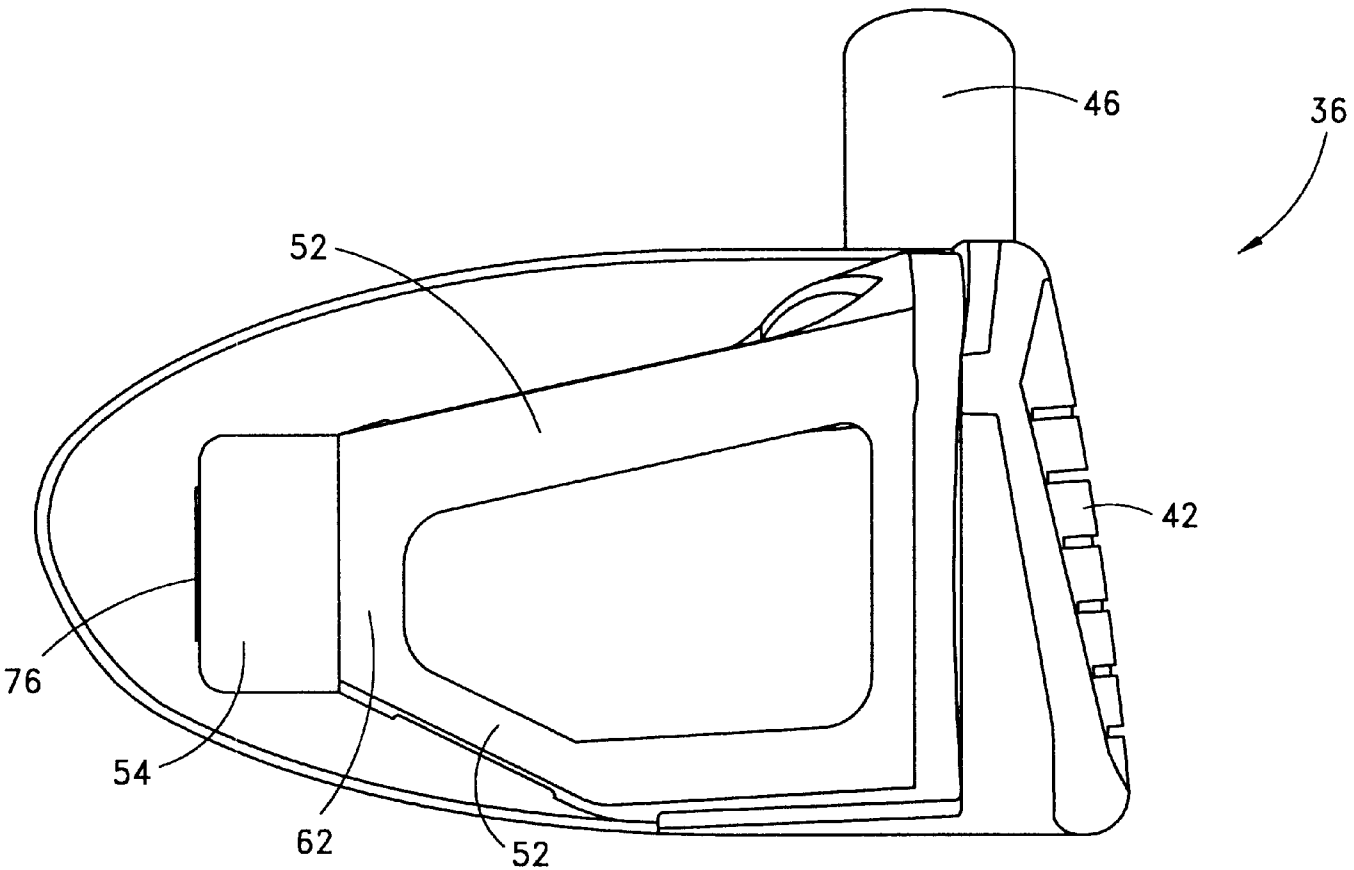
FIG. 9 is a side view of the golf club head of FIG. 7.

With reference to FIGS. 7–9, there is shown a second embodiment of the golf club head 36. The internal skeletal structure 50 comprises four skeletal members 52, including two top skeletal members 52*a, b* (FIG. 7) and two bottom skeletal members 52*c, d* (FIG. 8), each connected to the periphery of the strike plate 42. The skeletal members 52 each have a rounded beam-like structure. The weight 54 is disposed on a mounting plate 74 that is integrally connected to the second ends 62 of the skeletal members 52. A fastening member, such as a screw 76, is used to secure the weight 54 to the mounting plate 74.

As best shown in FIG. 8, the strike plate 42 includes a flange portion 78 that extends rearwardly from the bottom edge of the strike surface 44. The flange portion 78 defines the sole 47 of the club head 36. The rearward extension of the flange portion 78 effectively shortens the lengths of the bottom skeletal members 52*c, d* with respect to the lengths of the top skeletal members 52*a, b*.

In any of the embodiments, the skeletal members 52 may be provided with a cross-sectional shape that is configured to vary the load bearing characteristics of the skeletal structure 50. For example, in the embodiment shown in FIGS. 2–4, the skeletal members 52 have a circular cross-sectional shape. The skeletal members 50 in the embodiment shown in FIGS. 7 and 8 have a flattened, beam-like cross-sectional shape. In any event, the cross-sectional shape and interconnection pattern of the skeletal members 52 is preferably selected to absorb and distribute loads throughout the skeletal structure 50 and to impart maximum energy to the golf ball at impact, regardless of whether the shell 56 is present in the club head 36. The skeletal members are generally designed to have a cross-section which is structurally efficient for supporting large compressive and bending loads. Some suitable cross-sectional shapes are a circle, square, and I-beam.

Figure 10:
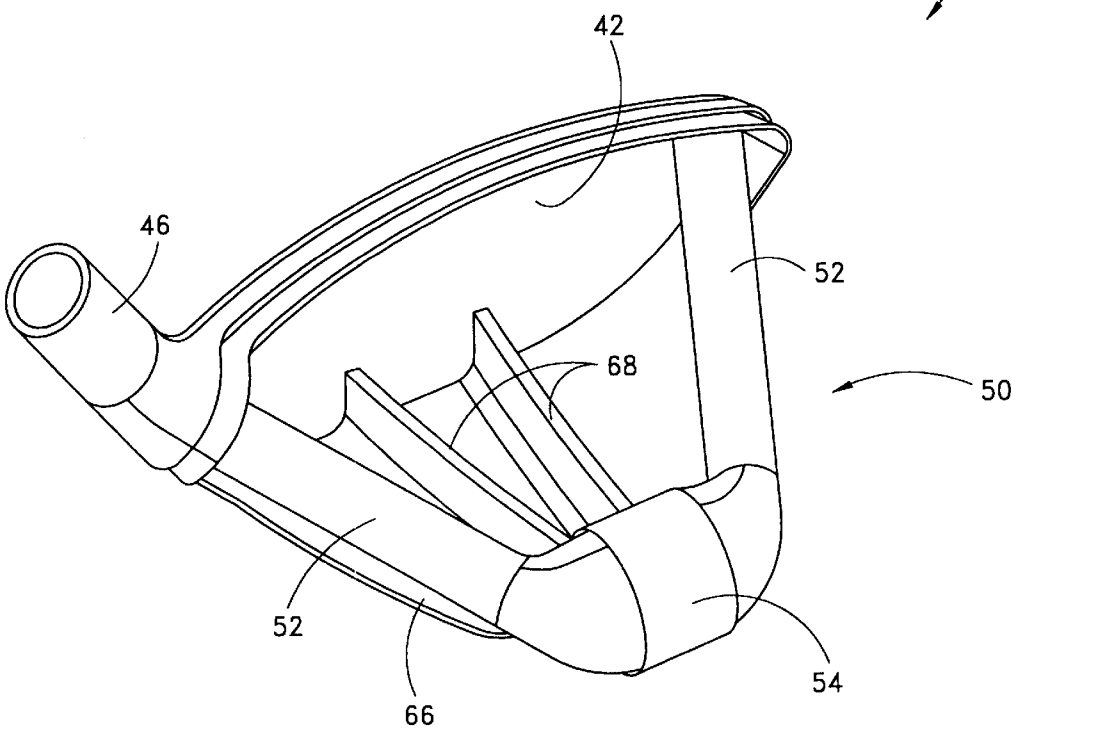
FIG. 10 is a perspective view of another embodiment of a golf club head having an internal skeletal structure.
Figure 12:
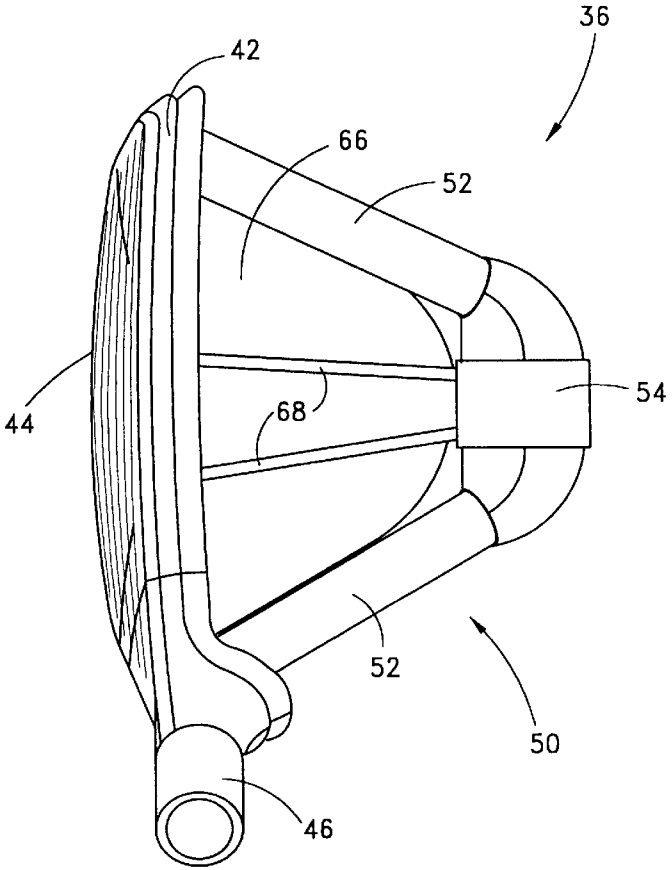
FIG. 12 is a top view of the golf club head of FIG. 10.
Figure 11:
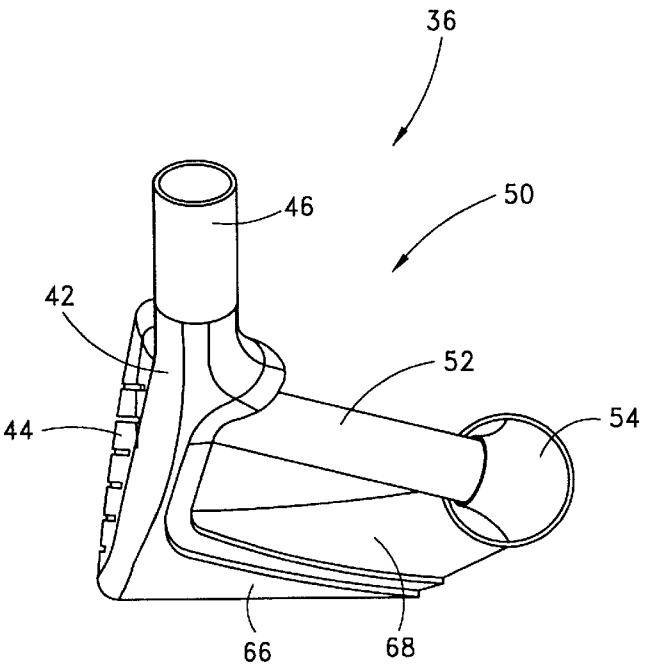
FIG. 11 is a side view of the golf club head of FIG. 10.

FIGS. 10–12 show another embodiment of a golf club head 36 having a skeletal structure 50. The skeletal structure 50 includes a pair of suspended skeletal members 52 that extend rearwardly from the strike plate 42. The skeletal members 52 each comprise a tube having one end attached to an upper region of the strike plate and a second end attached to a weight 54. The club head 36 further includes a sole plate 66 that extends rearwardly from the bottom edge of the strike plate 42 to define a lower surface of the club head 36.

At least one and, preferably, two ribs 68 are located on the sole plate 66. The ribs 68 have a first end attached to the strike plate 42 and a second end attached to the weight 54. The ribs 68 are attached near the bottom edge of the strike plate 42 substantially midway between the toe region 38 and heel region 40 of the club head 36. The ribs 68 provide partial support for the weight 54.

Figure 13:
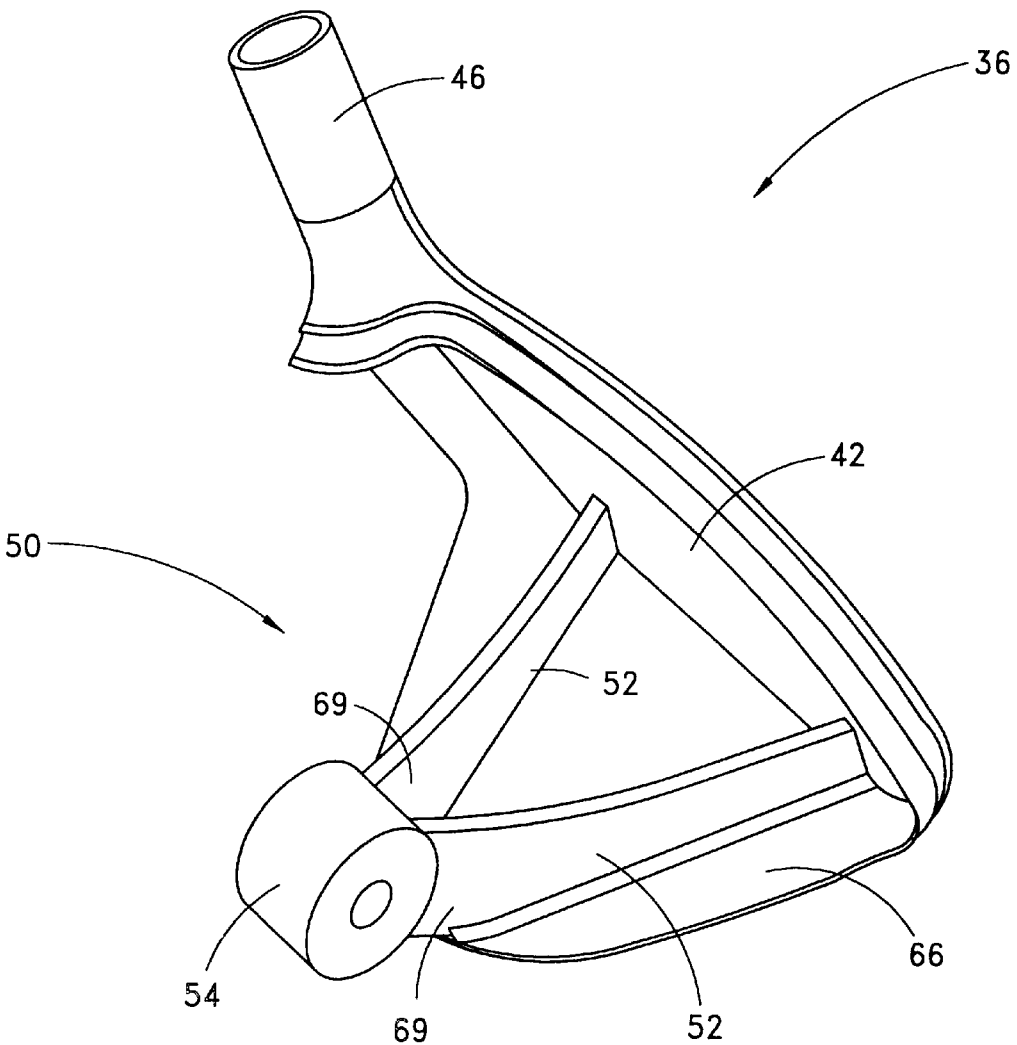
FIG. 13 is a perspective view of another embodiment of a golf club head having an internal skeletal structure.
Figure 15:
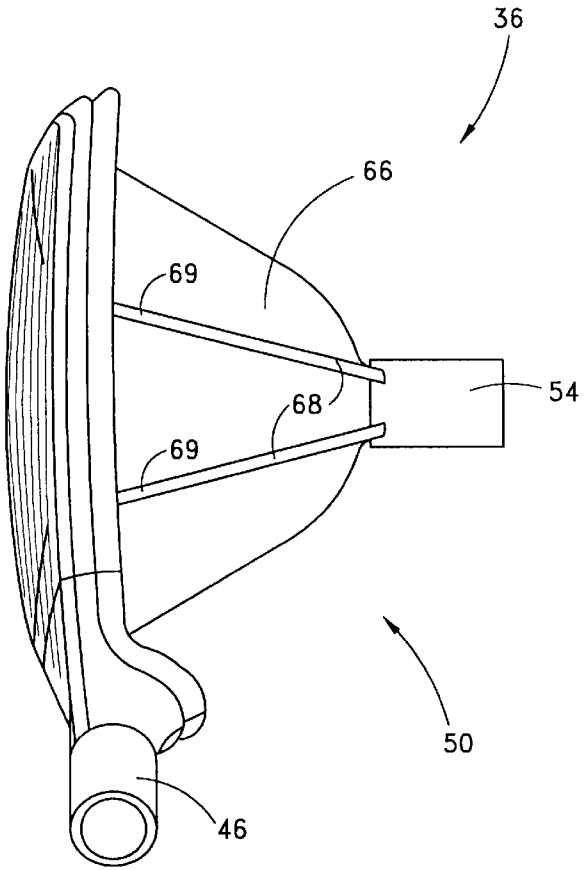
FIG. 15 is a top view of the golf club head of FIG. 13.
Figure 14:
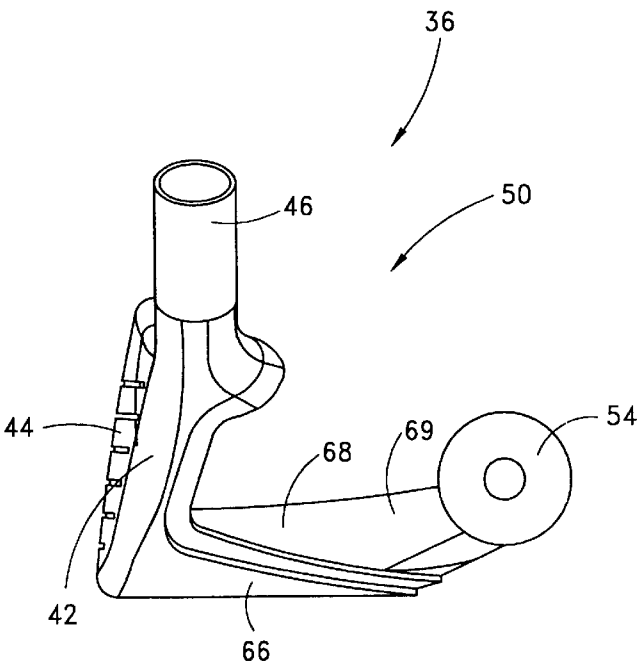
FIG. 14 is a side view of the golf club head of FIG. 13.

With reference to FIGS. 13–15, there is shown yet another embodiment of the golf club head 36. In this embodiment, the skeletal members 52 each comprise an elongate rib 68 that is located on a bottom sole plate 66. The ribs 68 extend rearwardly from the strike plate 42 to the rear of the club head 36. A second end 69 of each of the ribs 68 projects upwardly from the sole plate 66. The second ends 69 support the weight 54 in a position spaced at least 5 mm, preferably 7 mm, and more preferably 10 mm from the club head's outer envelope.

Figure 16:
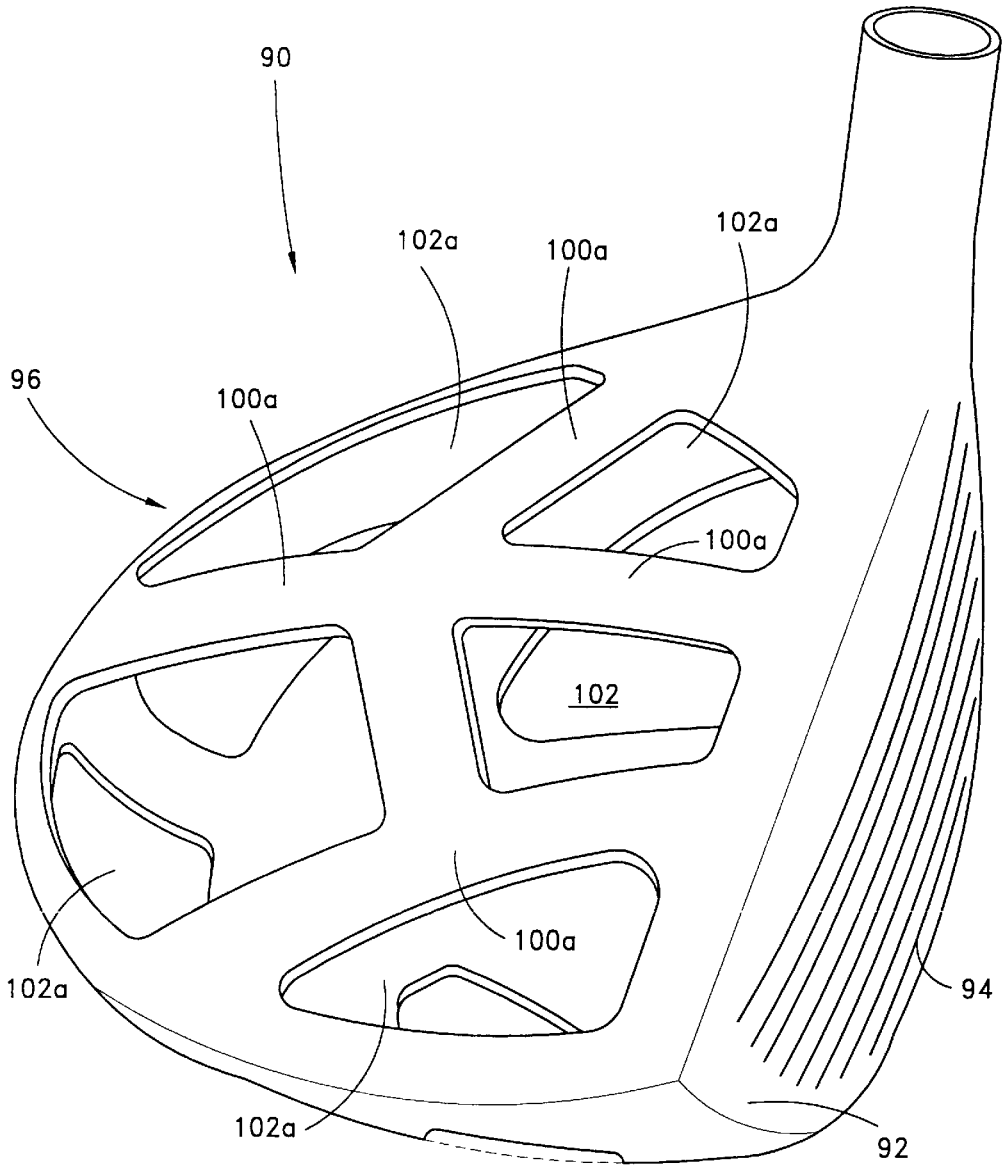
FIG. 16 is a front perspective view of a golf club head having an external skeletal structure.
Figure 17:
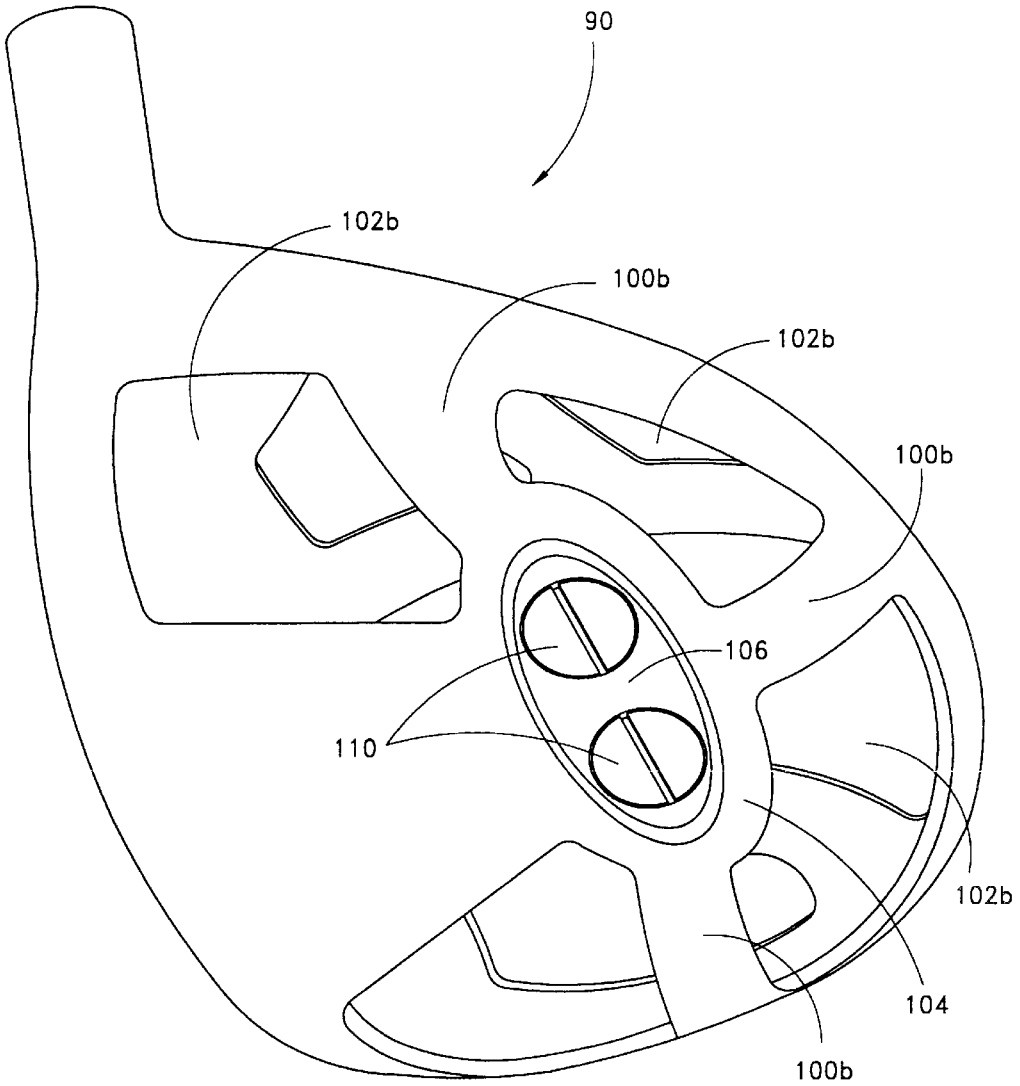
FIG. 17 is a bottom perspective view of the club head of FIG. 16.

FIGS. 16 and 17 are front and bottom perspective views, respectively, of another embodiment of a club head 90. The club head 90 comprises a strike plate 92 that defines a front surface or strike face 94. A skeletal structure 96 extends rearwardly from the strike plate 92. The skeletal structure 96 comprises a plurality of interconnected skeletal members 100, including a plurality of top skeletal members 100*a* and a plurality of bottom skeletal members 100*b*. The skeletal members 100 are arranged to collectively form the shape of a conventional driver-type club head.

The skeletal members 100 comprise thin, substantially flat plates that are integrally linked together along their lengths or at their ends. The skeletal members 100 preferably collectively define an internal volume of approximately 190 to 350 cubic centimeters. The interlinked arrangement of the skeletal members 100 results in a plurality of gaps 102 between the plurality of skeletal members 100. In particular, gaps 102*a* are formed in the crown of the club head, and gaps 102*b* are formed in the sole. The location and shape of the skeletal members 100 are preferably selected to optimize the load bearing characteristics of the skeletal structure 96, while still providing the club head with a shape that substantially conforms to the shape of a conventional club head.

With reference to FIG. 16, the top skeletal members 100*a* collectively form the upper surface or crown of the club head 90. In the illustrated embodiment, a pair of skeletal members 100*a* extend rearwardly from an upper edge of the strike plate 92. A pair of skeletal members 100*a* also extend transversely with respect to the rearwardly-extending skeletal members.

With reference to FIG. 17, the bottom skeletal members 100*b* collectively form the bottom surface or sole of the club head 90. The bottom skeletal members 100*b* converge at a common support plate 104 that is centrally-located on the sole of the club head 90. A weight 106 is disposed on the support plate 104. Preferably, the skeletal structure 100 supports substantially the entire weight of the weight 106. The weight 106 is shown attached to the support plate using attachment devices, such as screws 110, although other attachment means may be used, such as adhesive.

As discussed above with respect to the previous embodiment, the skeletal structure 96 and strike plate 92 preferably comprise the essential or basic components of the club head 90. The club head 90 is configured to withstand loads upon impact with a golf ball and propel the golf ball at impact. The gaps 102 therefore need not be filled with material in order for the club head 90 to be used in a golf club. However, as discussed above, USGA rules prohibit the use of a golf club having holes extending through the club head. Accordingly, the gaps 102 are preferably filled with a lightweight material.

The skeletal structure 96 is preferably comprised of a material that is configured to withstand impact with a golf ball. A suitable material is titanium, steel, or aluminum. The gaps 102 may be filled with plastics, composites, magnesium, or aluminum.

Figure 18:
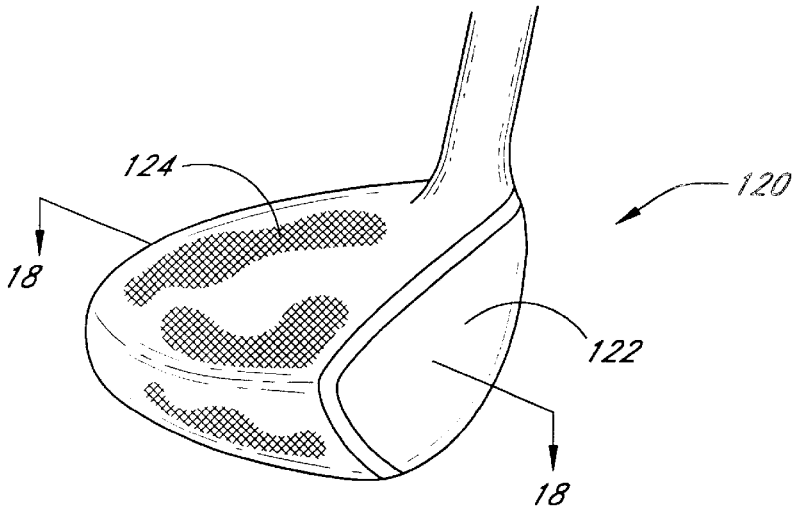
FIG. 18 is a perspective view of a golf club head having a metal strike plate corresponding to the face portion of the club head.
Figure 19:
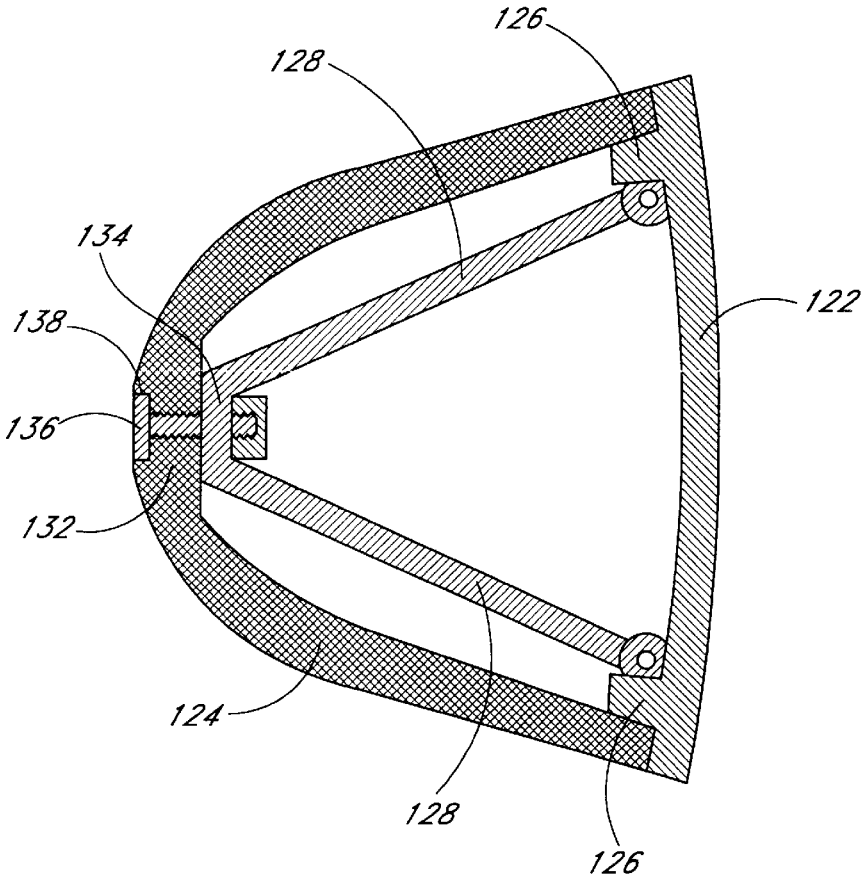
FIG. 19 is a sectional view of the golf club head of FIG. 18.

FIGS. 18 and 19 show an alternative embodiment of a golf club head according to the present invention. As shown, a golf club head 120 comprises a preferably metallic strike plate 122 attached to an open side of a hollow club head shell 124. The shell 124 may be formed by a molding process. The open side of shell 124 corresponds to the face portion of club head 120. The strike plate 122 may have an annular mating flange 126 extending into the cavity defined by shell 124 and being bonded to an annular interior surface at the opening of the shell. To enhance the attachment of strike plate 122 to shell 124, one or more skeletal support members 128 are attached near outer edges of the interior surface of strike plate 122, near the annular mating flange 126, as shown in FIG. 19. Preferably at least three skeletal members 128 are provided, in a tripod configuration. The support members 128 extend within the cavity of shell 124 toward an inner surface of a rear wall 132 of the shell. Preferably, skeletal members 128 are connected, integrally or otherwise, to an aft attachment portion 134 positioned adjacent the rear wall 132. Aft attachment portion 134 is secured to rear wall 132 to enhance the stability of the attachment of strike plate 122 to shell 124. Aft attachment portion 134 may be secured to rear wall 132 by any of a variety of means, such as welding or bonding, giving due consideration to the goal of providing a strong and long-lasting attachment. Preferably, a nut and bolt combination 136 is provided as shown in FIG. 19. A recess 138 may be provided in the exterior surface of rear wall 132 to receive the bolt head, as shown. Skeletal members 128 may be secured to the interior surface of strike plate 122 by various means, giving due consideration to the goal of a strong and long-lasting attachment. For example, members 128 may be welded, bonded, braised, integrally molded with, or hingedly attached (as shown in FIG. 19) to strike plate 122.

The golf club head configuration shown in FIGS. 18 and 19 advantageously provides a metallic surface for improved driving performance of the golf club on the golf course. Moreover, as in the previous embodiments, the skeletal members 128 are attached to the outer edges of strike plate 122 to permit some degree of inward flexure of the strike plate when striking a golf ball. In particular, strike plate 122 flexes slightly inwardly upon impact, and then snaps back to its original shape. Such inward flexure has been found to produce longer shots, due to the additional energy transferred to the golf ball by the snapping action of the strike plate as it returns back to its original shape. In contrast, prior art golf club heads have utilized a support attached to the center of the interior surface of a strike plate, effectively preventing any inward flexure thereof.

When a golf club head strikes a golf ball, there is an impact duration of about 450 $\mu$s between the moment of impact and the initiation of ball flight. During impact the ball compresses and substantially recovers its shape before leaving the club head face. Improved club head performance can be obtained by synchronizing the flexing and recovery of the face to the compression and recovery of the ball. FIGS. 20–23, described below, show three embodiments of a golf club head according to the present invention, having a mass 140 acting upon the skeletal structure, wherein the mass is biased by a resilient member such as a spring or elastomeric block. The resilient member is synchronized with the mass 140 to have a similar response time to that of the ball compression and rebound. Advantageously, the club heads of these embodiments can be tuned for optimal feel for the golfer, reduced shock stress to the skeletal structure; and improved performance, i.e., longer shots, on the golf course.

Figure 20:
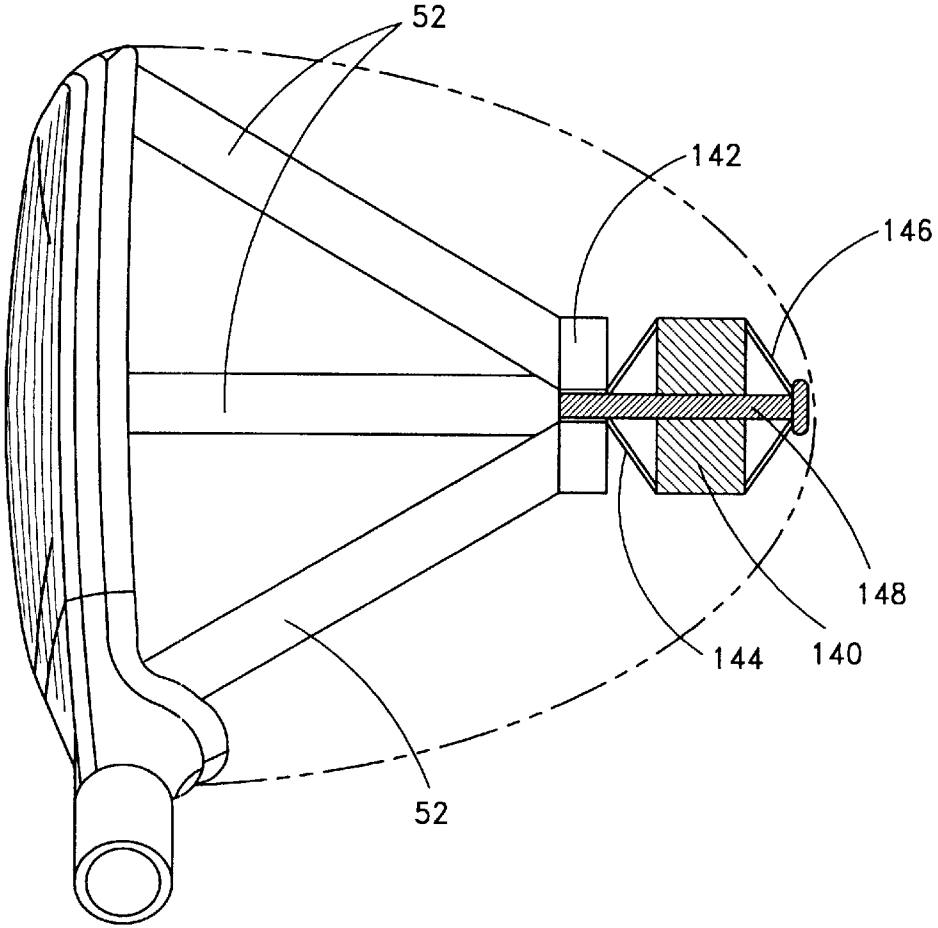
FIG. 20 is a top view of a golf club head having a skeletal structure and a spring-biased mass acting upon the skeletal structure.
Figure 21:
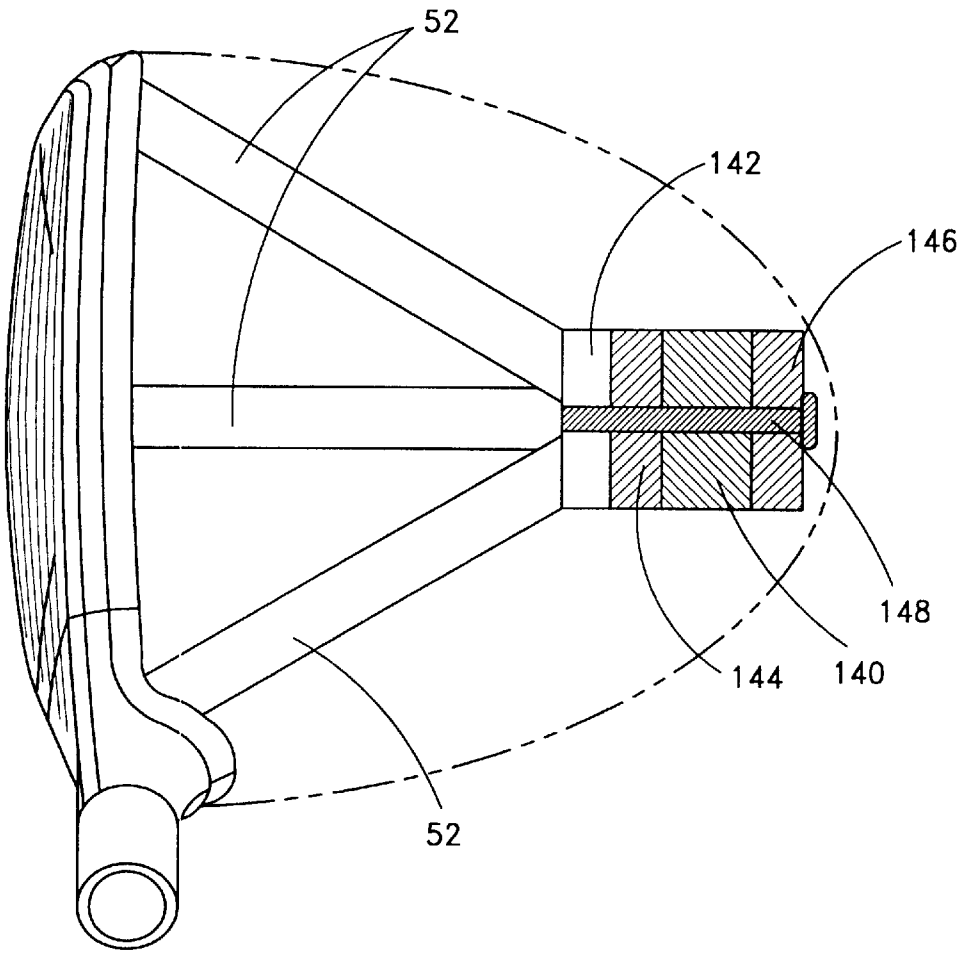
FIG. 21 is top view of a golf club head having a skeletal structure and a mass acting upon the skeletal structure and being biased by elastomeric spring blocks.

In the club head of FIG. 20, skeletal members 52 extend from the inner surface of the strike plate to a member 142 near the rear of the club head. A bolt 148 is threadingly engaged with member 142 and extends rearwardly therefrom. Between member 142 and bolt head 149, bolt 148 slidably engages mass 140 and springs 144 and 146. Thus, bolt 148 is rigidly secured to the skeletal structure of the club head, and mass 140 is free to translate along bolt 148 in a direction generally perpendicular to the plane of the strike plate. The stiffness of springs 144 and 146 is preferably selected so that the face deflection is synchronized to the ball compression. In a preferred embodiment, Belleville springs are used. The club head of FIG. 21 is similar to that of FIG. 20, with the exception that elastomeric spring blocks 150 and 152 are used in place of the springs 144 and 146. Mass 140 and blocks 150 and 152 are slidably engaged with the bolt 148.

Figure 22:
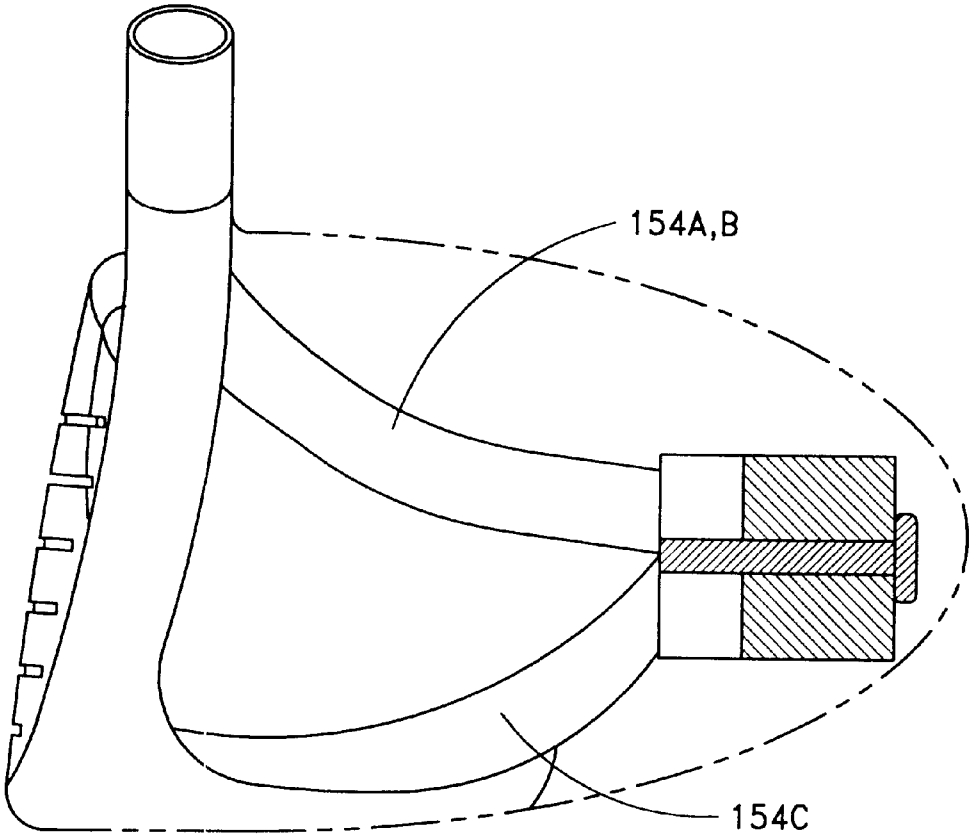
FIG. 22 is a side view of a golf club head having mass acting upon a compliant skeletal structure.
Figure 23:
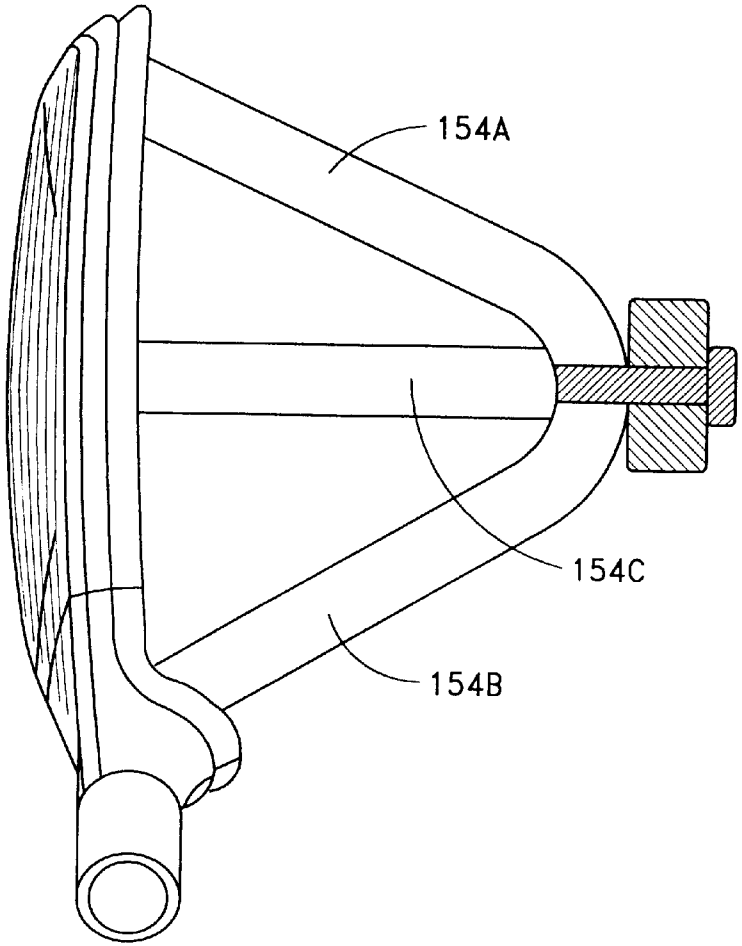
FIG. 23 is a top view of the golf club head of FIG. 22.

Another approach, shown in FIGS. 22 and 23, is to achieve compliance from the skeletal support structure. This club head has compliant supports 154*a*, 154*b*, and 154*c*which extend rearwardly from the strike plate to the mass 140 at the rear of the club head. The supports 154*a–c* may be slightly curved as shown to enhance compliance thereof.

Although the foregoing description of the preferred embodiment of the invention has shown, described, and pointed out certain novel features of the invention, it will be understood that various omissions, substitutions, and changes in the form of the detail of the apparatus as illustrated as well as the uses thereof, may be made by those skilled in the art without departing from the spirit of the present invention. Consequently, the scope of the present invention should not be limited by the foregoing discussion, which is intended to illustrate rather than limit the scope of the invention.

What is claimed is:

1. A golf club, comprising:

a shaft;

a club head coupled to the shaft, the club head comprising a strike face, a sole plate, a shell defining an interior volume, and skeletal structure comprised of a plurality of elongated ribs secured to the sole plate; and a weight substantially entirely supported by the ribs, wherein the weight and the skeletal structure are substantially entirely located within a lower half of the interior volume, the lower half of the interior volume being adjacent the sole plate, the weight and the skeletal structure collectively comprising at least 30% of the entire weight of the club head.

2. The golf club of claim 1, wherein the shell encloses the skeletal structure.

3. The golf club of claim 2, wherein the ribs are attached to the periphery of the strike face.

4. The golf club of claim 1, wherein the shell comprises a material that plastically deforms or breaks when subject to impact with a golf ball at a speed of 100 mph.

5. The golf club of claim 1, wherein the club head further comprises a strike plate that defines the strike face and wherein at least one of the ribs extends rearwardly from the strike face.

6. The golf club of claim 1, wherein the weight is suspended within the interior volume.

7. The golf club of claim 1, wherein each of the ribs is secured to the sole plate substantially entirely along the rib's length.

8. The golf club of claim 1, wherein at least one of the ribs has a rearward end extending rearward of the sole plate, the weight being secured to the rearward end.

9. The golf club of claim 1, wherein at least one of the ribs has a rearward end projecting upward from the sole plate, the weight being secured to the rearward end.

10. A golf club, comprising:

a shaft; and a club head coupled to the shaft, the club head comprising a strike plate defining a strike face, a shell defining an interior volume, a sole plate, and a skeletal structure reinforcing the sole plate, the skeletal structure being substantially entirely located within a lower half of the interior volume, the lower half being adjacent to the sole plate, wherein the strike plate and skeletal structure bear at least 50% of the load when a golf ball is struck by the strike face.

11. The golf club of claim 10, wherein the skeletal structure comprises a plurality of ribs secured to the sole plate.

12. A golf club, comprising:

a shaft;

a golf club head coupled to the shaft, the golf club head comprising a strike plate and a shell having an interior surface defining exactly one contiguous interior volume; said strike plate and said shell defining a substantially closed exterior envelope; and a weight, wherein the weight comprises at least 20% of the weight of the club head and the weight is spaced at least 5 mm from the envelope defined by the outer shell and the strike plate, the weight being completely inside of and not forming a portion of the exterior envelope.

13. A golf club, comprising:

a shaft;

a club head coupled to said shaft, said club head comprising a strike face, a shell defining an interior volume, and a compliant skeletal structure acting upon the strike face, the skeletal structure comprising a plurality of elongate skeletal members; and a weight substantially entirely supported by said skeletal structure;

wherein the compliance of said skeletal structure is such that an impact of said strike face with a golf ball causes both said strike face and the ball to elastically deform and then return to undeformed shapes of said strike face and the ball, wherein said strike face and the ball return to said undeformed shapes at substantially the same moment after the impact.

14. The golf club of claim 13, said skeletal members being curved to provide compliance to said skeletal structure.

15. A golf club, comprising:

a shaft; and a club head coupled to the shaft, the club head comprising a strike face, a sole plate, a skeletal structure comprised of a plurality of elongate skeletal members secured along portions of their lengths to the sole plate, and a weight plug supported by the skeletal structure, wherein at least one of the skeletal members has a rearward end extending rearward of the sole plate, the weight plug being secured toe,the rearward end, substantially all of said skeletal members originating from said strike face.

16. A golf club, comprising:

a shaft; and a club head coupled to the shaft, the club head comprising a strike face, a sole plate, a skeletal structure comprised of a plurality of elongate skeletal members secured along portions of their lengths to the sole plate, and a weight plug supported by the skeletal structure, wherein at least one of the skeletal members has a rearward end projecting upward from the sole plate, the weight plug being secured to the rearward end substantially all of said skeletal members originated from said strike face.

17. A golf club, comprising:

a shaft;

a club head coupled to the shaft, the club head comprising a strike face, a sole plate, a shell having an interior surface defining an interior volume, and a skeletal structure comprised of a plurality of elongate skeletal members being secured along portions of their lengths to the sole plate, substantially all of the skeletal members originating from the strike face; and a weight plug supported by the skeletal structure, wherein substantially all of the elongate members terminate at the weight plug substantially within a rear half of the interior volume, the rear half of the interior volume being located opposite a remaining front half of the interior volume adjacent to the strike face.

18. A golf club comprising:

a shaft;

a club head adjoining the shaft and defining an interior volume, the club head comprising a strike plate, a sole plate, and a plurality of elongated skeletal members located within the interior volume, a majority of the length of each of the skeletal members being secured to the sole plate; and a weight substantially entirely located in a rear half of the interior volume;

wherein each of the skeletal members originates from the strike plate and terminates at the weight.

19. A golf club, comprising:

a shaft;

a club head coupled to the shaft, the club head comprising a strike face, a sole plate, a shell defining an interior volume, and a skeletal structure comprised of a plurality of elongated ribs secured to the sole plate, and a weight substantially entirely supported by the ribs; wherein the weight and the skeletal structure collectively comprise at least 30% of the entire weight of the club head, the weight being suspended within the interior volume.

20. A golf club, comprising:

a shaft;

a club head coupled to the shaft, the club head comprising a strike face, a sole plate, a shell defining an interior volume, and a skeletal structure comprised of a plurality of elongated ribs secured to the sole plate, and;

a weight substantially entirely supported by the ribs, wherein the weight and the skeletal structure collectively comprise at least 30% of the entire weight of the club head, at least one of the ribs having a rearward end extending rearward of the sole plate, the weight being secured to the rearward end.

21. A golf club, comprising:

a shaft;

a club head coupled to the shaft, the club head comprising a strike face, a sole plate, a shell defining an interior volume, and a skeletal structure comprised of a plurality of elongated ribs secured to the sole plate, and a weight substantially entirely supported by the ribs, wherein the weight and the skeletal structure collectively comprise at least 30% of the entire weight of the club head, at least one of the ribs having a rearward end projecting upward from the sole plate, the weight being secured to the rearward end.

22. A golf club, comprising:

a shaft;

a club head coupled to the shaft, the club head comprising a strike face, a sole plate, and a skeletal structure comprised of a plurality of elongate skeletal members secured along portions of their lengths to the sole plate, and a weight plug supported by the skeletal structure, wherein at least one of the skeletal members has a rearward end extending rearward of the sole plate, the weight plug being secured to the rearward end.

23. A golf club, comprising:

a shaft;

a club head coupled to the shaft, the club head comprising a strike face, a sole plate, a skeletal structure comprised of a plurality of elongate skeletal members secured along portions of their lengths to the sole plate, and a weight plug supported by the skeletal structure, wherein at least one of the skeletal members has a rearward end projecting upward from the sole plate, the weight plug being secured to the rearward end.

* * * * *

UNITED STATES PATENT AND TRADEMARK OFFICE

CERTIFICATE OF CORRECTION

PATENT NO. : 6,558,271 B1
DATED : May 6, 2003
INVENTOR(S) : Beach et al.

It is certified that error appears in the above-identified patent and that said Letters Patent is hereby corrected as shown below:

Title page, Item [54] and Column 1, lines 1 and 2,
The correct title should be -- GOLF CLUB HEAD HAVING SKELETAL SUPPORT STRUCTURE --

Signed and Sealed this

Second Day of September, 2003

JAMES E. ROGAN
*Director of the United States Patent and Trademark Office*